US007172802B2

(12) United States Patent
Sutherland et al.

(10) Patent No.: US 7,172,802 B2
(45) Date of Patent: Feb. 6, 2007

(54) CASEMENT FABRICS

(76) Inventors: Ann M. Sutherland, 3131 Maple Ave., Dallas, TX (US) 75201; David F. Sutherland, 3131 Maple Ave., Dallas, TX (US) 75201

( * ) Notice: Subject to any disclaimer, the term of this patent is extended or adjusted under 35 U.S.C. 154(b) by 957 days.

(21) Appl. No.: 10/034,907

(22) Filed: Dec. 27, 2001

(65) Prior Publication Data

US 2003/0186606 A1 Oct. 2, 2003

(51) Int. Cl.
*B32B 3/10* (2006.01)

(52) U.S. Cl. ..... 428/131; 442/49; 442/131; 442/301; 442/302; 442/2; 428/134; 139/417; 139/418

(58) Field of Classification Search ..... 442/131, 442/301, 302, 2, 49; 428/131, 134; 139/417, 139/418

See application file for complete search history.

(56) References Cited

U.S. PATENT DOCUMENTS 2,039,987 A * 5/1936 Goldman ..... 139/428
3,417,794 A * 12/1968 Lynch et al. ..... 139/420 C
4,002,188 A * 1/1977 Hanks ..... 139/420 R
4,587,997 A * 5/1986 Brooks ..... 139/420 R
4,751,117 A * 6/1988 Goodfellow ..... 442/209
4,861,651 A * 8/1989 Goldenhersh ..... 442/131
5,103,848 A * 4/1992 Parsons ..... 135/20.2
5,503,917 A * 4/1996 Hughes ..... 442/181
6,037,280 A * 3/2000 Edwards et al. ..... 442/131
6,106,947 A * 8/2000 Smith ..... 442/133
6,268,450 B1 * 7/2001 Wade ..... 526/240

OTHER PUBLICATIONS

Complete Textile Glossary, 2001, Celanese Acetate, LLC.*
US 5,637,347, 06/1997, Thompson et al. (withdrawn)*

* cited by examiner

*Primary Examiner*—Elizabeth M. Cole
(74) *Attorney, Agent, or Firm*—Gardere Wynne Sewell LLP

(57) ABSTRACT

Window coverings are formed of woven fabrics of acrylic yarns to provide minimal degradation of the window covering due to ultraviolet (UV) radiation and to minimize damage to interior furnishings within a building at which the window coverings are applied. The window coverings are preferably formed of panels of pigmented acrylic yarn having a yarn number of about 24, 2 ply and a weave density of about 29 ends per inch of warp threads and 24 picks per inch of weft threads with about 0.063 inch square openings between the thread rows. UV blocking for A and B wavelength ranges may be on the order of 69 to 78 percent.

8 Claims, 1 Drawing Sheet

CASEMENT FABRICS

BACKGROUND OF THE INVENTION

Ultraviolet light sources, such as sunlight, are particularly detrimental to many articles of manufacture whether such articles be made of natural or man-made materials. For example, sunlight is particularly detrimental to window coverings and furnishings within a residential dwelling as well as commercial buildings of all types.

Accordingly, it is desirable to minimize the damage to the structure and appearance of certain articles, such as window coverings, carpeting and furnishings within a dwelling or other type of human occupied building, while at the same time allowing sufficient light to the room or rooms of the building to satisfy human needs as well as aesthetic qualities or characteristics of the room. For example, window coverings known as sheers are hung in many windows in addition to completely opaque window coverings, such as draperies and the like, to allow light to enter the room and to also permit humans occupying the room to see through the fabric of the sheers to the outside world. However, heretofore, fabrics used for and the light transmitting characteristics of known types of sheers have been unsuitable to prevent damage from ultraviolet radiation or light to the sheers themselves, as well as to opaque window coverings and the furnishings within the room at which the window coverings are hung.

Taking into account the vast number of residential dwellings, commercial office buildings, hotels and other buildings which are windowed and suffer from damage due to ultraviolet light, there has been a substantial need to provide improved window coverings which will reduce such damage while at the same time providing for admission of substantial natural light into the interior of the dwelling or building and to permit human occupants to see through the window coverings to the outside world.

SUMMARY OF THE INVENTION

The present invention provides an improved fabric particularly useful as a window covering for admitting artificial and, particularly, natural light into a room or rooms while allowing human occupants to see through the window covering, which window covering is also operable to substantially reduce the amount of ultraviolet light (radiation) which is admitted to the room through the window covering to thereby minimize damage from such radiation to articles of manmade and natural materials.

In accordance with one aspect of the present invention an improved fabric, particularly adapted for a window covering or the like, is provided which is formed of a woven material. The threads of the woven material are preferably formed of staple fiber yarn of an acrylic polymer, and, in particular, a pigmented acrylic polymer. It has been determined that so-called pigmented acrylic polymer yarns are particularly resistant to damage from ultraviolet light. Moreover, fabrics formed of such yarns also have superior ultraviolet light absorption or reflectivity characteristics which, when such fabrics are used as window coverings, substantially reduce damage to the window coverings and articles within a room or rooms at which the window coverings are hung.

In accordance with a further aspect of the present invention an improved window covering is provided which allows the admission of substantial light through the window covering, and permits a desired amount of visibility through the window covering, while also blocking the transmission of a substantial amount of ultraviolet light through the fabric of the window covering. In a preferred embodiment of the invention the window covering is formed of woven yarns of acrylic. The fiber content of the yarn is preferably substantially one hundred percent pigmented acrylic which is so-called solution-dyed, and the fiber has a denier of about 2.0. The yarn also, preferably, has a yarn number of twenty-four and is 2 ply. The weave density of the fabric, which may be varied, is, preferably, 29 ends per inch at the warp while the weft or fill is 24 picks per inch. The weave structure is also, preferably, a three strand warp with preferably about 0.063 inch square openings between the warp and weft rows. The colors of the warp and weft or fill yarns may be varied to meet particular aesthetic requirements.

The fabric of the invention may be considered somewhat reminiscent of so-called mosquito netting. The fabric in accordance with a preferred specification of the invention has revealed a substantial capability for blocking or reducing the transmission of ultraviolet radiation therethrough. For example, the percentage of blocking of ultraviolet A radiation (UVA) is as high as about 76 percent while the blocking of ultraviolet B radiation (UVB) may be as high as about 78 percent. Moreover, the fabric can be treated with a suitable organic flame retardant and a stain protection finish without affecting its ability to reduce ultraviolet light transmission and without being deleteriously affected by ultraviolet light itself.

Those skilled in the art will further appreciate the advantages and superior features of the present invention upon reading the detailed description which follows in conjunction with the drawing.

DETAILED DESCRIPTION OF A PREFERRED EMBODIMENT

Figure 1:
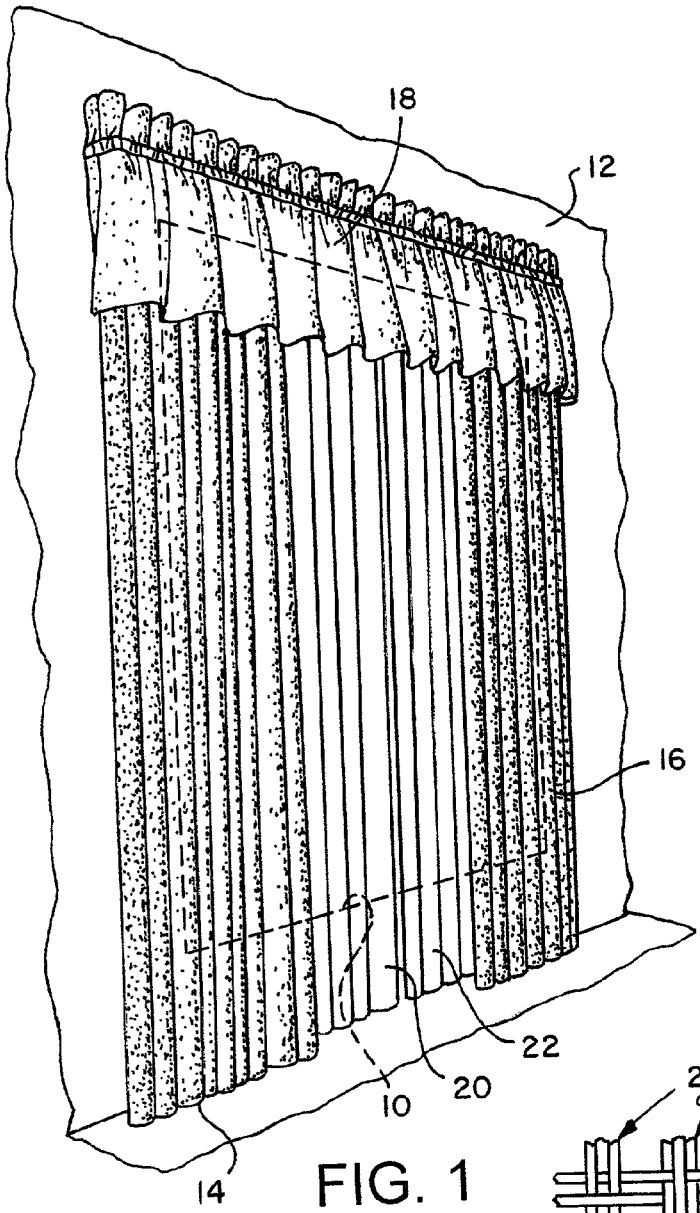
FIG. 1 is an interior perspective view of a typical residential or commercial building room having a window with window coverings in accordance with the present invention.

In the description which follows like elements are marked throughout the specification and drawing with the same reference numerals, respectively. The drawing figures may not be to scale and certain elements may be shown in schematic or generalized form in the interest of clarity and conciseness.

Referring to FIG. 1, there is illustrated a typical application of the casement fabric of the present invention as a window covering for a window 10 disposed in an exterior wall 12 of a building or residential dwelling. The window 10 is decorated by a conventional set of opaque window coverings such as drapery panels 14 and 16 which are hung in a conventional manner together with a valance 18. The window 10 is also covered by light admitting window coverings or sheers comprising one or more panels 20 and 22 which are also hung in a conventional manner between the window 10 and the opaque window coverings 14, 16, 18. The panels 20 and 22 are formed of an improved window covering fabric in accordance with the invention, which fabric is resistant to ultraviolet light (radiation) in both the UVA and UVB wavelength ranges. However, the window covering panels 20 and 22 also admit substantial light through the window 10 and into the interior of the room at which the window is disposed while allowing persons within the room to view the outside world in some detail through the window covering panels in their closed position, as shown.

Figure 3:
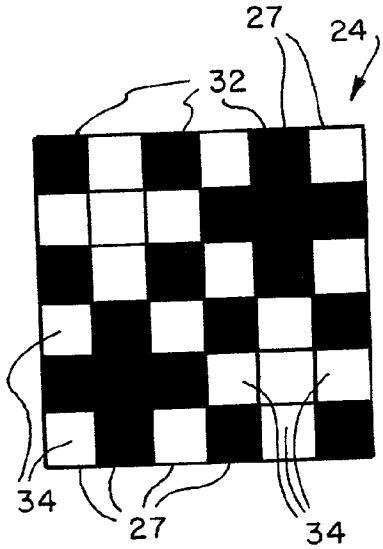
FIG. 3 is a schematic diagram showing the weave pattern in accordance with one preferred embodiment of the present invention.
Figure 2:
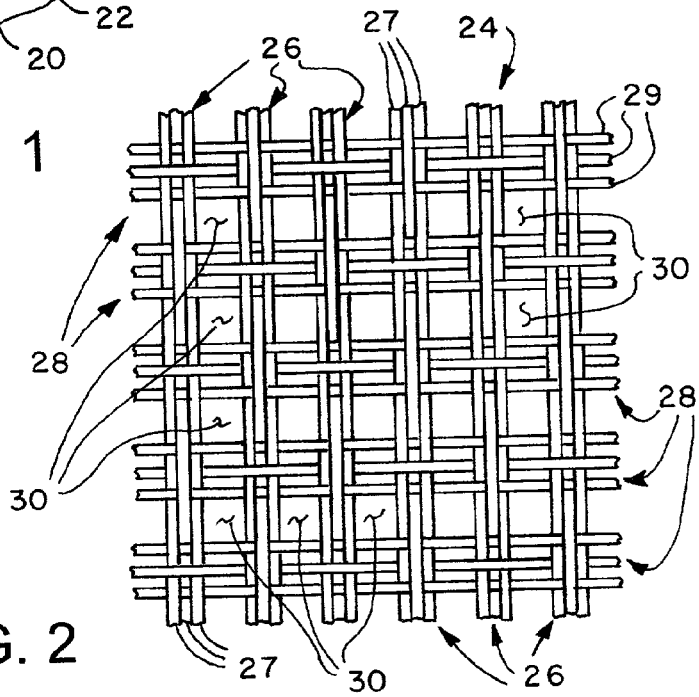
FIG. 2 is a detail plan view showing the threads and the weave of a window covering or casement fabric article in accordance with the present invention.

Referring now to FIG. 2, a detail plan view of a portion of one of the window covering panels 20 or 22 is illustrated to show the general construction of the fabric which forms the panels 20 and 22. One preferred embodiment of fabric making up the panels 20 and 22 is illustrated in FIG. 2 and generally designated by the numeral 24. The fabric 24 is preferably formed of a so-called pigmented or solution dyed polymer yarn, and more preferably yarn formed of acrylic (acrylonitrile) fibers. Pigmented or solution dyed yarn is formed by adding a coloring agent to the polymer material and thoroughly mixing the coloring agent throughout the polymer material at the time the polymer material itself is formed, as compared with adding a coloring agent or dye to the polymer material after formation thereof. Acrylic yarn, so formed, is preferred for its resistance to degradation by ultraviolet light (radiation) as well as for its ultraviolet radiation (UV) absorbing or reflectivity capability in accordance with the invention. A fiber content of substantially all acrylic, solution-dyed, is preferred, the fibers having a denier of about 2.0. In the fabric 24 the yarn strands preferably have a count or yarn number of twenty-four and are 2-ply. The weave structure is preferably formed of groups 26 made up of three warp strands or threads 27 and groups 28 which are also each formed of three weft or fill strands or threads 29. The spacing of the threads is approximately twenty-nine ends per inch for the warp threads 27 and twenty-four picks per inch for the weft or fill threads 29, leaving approximately 0.063 inch square openings 30 between adjacent groups 26 and 28 of warp and fill threads. This weave structure provides a weight per lineal yard of approximately 5.5 ounces for the yarn description herein. FIG. 3 is a schematic diagram of the weave structure with the raised picks indicated for each thread or strand 27 by the dark squares 32 and the lowered picks for each thread or strand 27 indicated by the lighter squares 34.

A fabric having the specifications set forth hereinabove has been indicated to be capable of blocking ultraviolet (UV) light in the A category wavelength in a range of about 69 to 76 percent, depending on fabric color, while also being capable of blocking UV light in the B category wavelength in a range of about 74 to 78 percent. Accordingly, a light transmitting fabric in accordance with the present invention is not only resistant itself to damage from ultraviolet light but is capable of blocking a significant amount of UV light transmission therethrough while admitting a sufficient amount of light to be aesthetically pleasing and while also permitting reasonable visual acuity by persons viewing objects on the other side of the fabric from where the person is disposed. As previously mentioned, for aesthetic purposes, the colors of the warp threads and weft threads may be different and the colors of each thread in a group 26 or 28 may be different also.

Window covering panels 20 and 22 formed of the fabric 24 may be treated with a commercially available flame retardant and a stain protection finish, respectively. One preferred source of flame retardant is Schneider-Banks Co., Athens, Tex. The fabric edges may be suitably bound by conventional methods.

The weave structure for the fabric 24 may be varied. For example, the weave pattern may be a plain weave and the weave density may be varied to provide openings 30 of from 0.03 to 0.25 inches square. However, the weave structure with the warp threads alternating over/under/over and the weft threads alternating with under/over/under is indicated to be preferred to maintain structural integrity and UV blocking capability.

Although a preferred embodiment of the invention has been described in detail herein, those skilled in the art will recognize that various substitutions and modifications may be made to the casement fabric described without departing from the scope and spirit of the appended claims.

What is claimed is:

1. A light transmitting window covering panel formed of a fabric comprising staple fiber acrylic yarn, woven in groups of warp threads and groups of weft threads the fiber content of said yarn being about 100 percent pigmented acrylonitrile polymer, and the weave density being such as to provide openings between said groups of warp threads and said groups of weft threads of about 0.03 inches to 0.25 inches to provide human visual perception through said panel and blocking the transmission of ultraviolet light through said panel in A category wavelength in a range of about 69 percent to 76 percent and in B category wavelength in a range of about 74 percent to 78 percent.

2. The window covering set forth in claim 1 wherein:

each group of warp threads comprises three threads disposed adjacent one another between said openings, respectively.

3. The window covering set forth in claim 1 wherein:

each group of weft threads comprises three threads disposed adjacent one another between said openings, respectively.

4. The window covering set forth in claim 1 wherein:

the yarn weight is not less than a yarn number of about 24.

5. The window covering set forth in claim 4 wherein:

the yarn is 2 ply.

6. A light transmitting window covering panel comprising a an ultraviolet radiation resistant fabric formed of acrylic yarn woven in groups of warp threads and groups of weft threads, the fiber content of said yarn being about 100 percent pigmented acrylonitrile polymer, the yarn weight being not less than a yarn number of about 24 and the weave density of said fabric is such as to provide openings between groups of adjacent warp threads and groups of adjacent weft threads in a range of about 0.03 to .25 inches square to provide human visual perception through said panel and blocking the transmission of ultraviolet light through said panel in A category wavelength of at least about 69 percent and in B category wavelength of at least about 74 percent.

7. The window covering set forth in claim 6 wherein:

each group of warp threads comprises three threads disposed adjacent one another between said openings, respectively.

8. The window covering set forth in claim 6 wherein:

each group of weft threads comprises three threads disposed adjacent one another between said openings, respectively.

* * * * *